US006946968B1

(12) United States Patent
Johnson

(10) Patent No.: US 6,946,968 B1
(45) Date of Patent: Sep. 20, 2005

(54) HYDRAULIC STROKE MEASURING SYSTEM

(76) Inventor: Clifford C. Johnson, 1217 23rd St. SE., Mandan, ND (US) 58554

( * ) Notice: Subject to any disclaimer, the term of this patent is extended or adjusted under 35 U.S.C. 154(b) by 47 days.

(21) Appl. No.: 10/671,226

(22) Filed: Sep. 24, 2003

(51) Int. Cl.[7] ..... G08B 21/00
(52) U.S. Cl. ..... 340/686.1; 340/686.3; 340/815.4; 73/1.79
(58) Field of Search ..... 340/686.1, 686.3, 340/686.6, 815.4, 825.36; 73/1.79

(56) References Cited

U.S. PATENT DOCUMENTS

| | | | | |
|---|---|---|---|---|
| 4,399,881 A | | 8/1983 | Theurer et al. | 177/137 |
| 4,792,272 A | | 12/1988 | Oswald et al. | 414/458 |
| 5,056,036 A | | 10/1991 | Van Bork | 364/510 |
| 5,167,289 A | | 12/1992 | Stevenson | 177/141 |
| 5,523,684 A | * | 6/1996 | Zimmermann | 324/207.22 |
| 5,905,215 A | | 5/1999 | Jin et al. | 73/865.9 |
| 5,971,380 A | | 10/1999 | Hebener | 269/20 |
| 5,975,215 A | | 11/1999 | Jensen et al. | 172/407 |
| 6,108,948 A | | 8/2000 | Tozawa et al. | 37/348 |
| 6,193,219 B1 | | 2/2001 | Belley et al. | 254/894 |
| 6,318,167 B1 | | 11/2001 | Power | 73/168 |
| 6,321,781 B1 | * | 11/2001 | Kurth | 137/554 |
| 6,442,862 B1 | * | 9/2002 | Kimura et al. | 33/732 |
| 6,666,784 B1 | * | 12/2003 | Iwamoto et al. | 474/109 |
| 2001/0004109 A1 | | 6/2001 | Belley et al. | 254/89 |
| 2002/0017637 A1 | | 2/2002 | Belley et al. | 254/89 |

FOREIGN PATENT DOCUMENTS

| | | |
|---|---|---|
| FR | 2575128 | 6/1986 |
| JP | 2002/363997 | 12/2002 |

* cited by examiner

*Primary Examiner*—Phung T. Nguyen

(57) ABSTRACT

A hydraulic stroke measuring system for accurately determining the cylinder rod position within a hydraulic cylinder. The hydraulic stroke measuring system includes a measurement shaft slidably positioned within a housing unit, a shaft bracket attachable between the measurement shaft and a cylinder shaft of a hydraulic cylinder, a plurality of contact members within the housing unit, a main contact attached to the measurement shaft for selectively engaging one or more of the contact members, and a plurality of display lights electrically connected to the contact members. The display lights illuminate when the main contact engages the corresponding contact members.

18 Claims, 7 Drawing Sheets

HYDRAULIC STROKE MEASURING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hydraulic cylinders and more specifically it relates to a hydraulic stroke measuring system for accurately determining the cylinder rod position within a hydraulic cylinder.

2. Description of the Related Art

Hydraulic cylinders have been in use within agriculture, construction and other industries for years. A conventional hydraulic cylinder has a cylinder housing and a cylinder shaft slidably extending from the cylinder housing. Pressurized hydraulic fluid is input into the cylinder housing to force the cylinder rod inwardly or outwardly with respect to the cylinder housing.

The main problem with conventional hydraulic cylinders is the user cannot determine the exact position of the cylinder rod. A further problem with conventional hydraulic cylinders is that equipment dependent upon the hydraulic cylinders are sometimes operated at an incorrect depth or height. For example, if a planter is not adequately lowered so that the discs are penetrating the ground surface at a desired depth, the seeds will not be properly planted resulting in the loss of that crop.

While these devices may be suitable for the particular purpose to which they address, they are not as suitable for accurately determining the cylinder rod position within a hydraulic cylinder. Conventional hydraulic cylinders do not provide a system for indicating the exact position of the cylinder rod.

In these respects, the hydraulic stroke measuring system according to the present invention substantially departs from the conventional concepts and designs of the prior art, and in so doing provides an apparatus primarily developed for the purpose of accurately determining the cylinder rod position within a hydraulic cylinder.

BRIEF SUMMARY OF THE INVENTION

In view of the foregoing disadvantages inherent in the known types of cylinder systems now present in the prior art, the present invention provides a new hydraulic stroke measuring system construction wherein the same can be utilized for accurately determining the cylinder rod position within a hydraulic cylinder.

The general purpose of the present invention, which will be described subsequently in greater detail, is to provide a new hydraulic stroke measuring system that has many of the advantages of the hydraulic cylinder systems mentioned heretofore and many novel features that result in a new hydraulic stroke measuring system which is not anticipated, rendered obvious, suggested, or even implied by any of the prior art hydraulic cylinders, either alone or in any combination thereof.

To attain this, the present invention generally comprises a measurement shaft slidably positioned within a housing unit, a shaft bracket attachable between the measurement shaft and a cylinder shaft of a hydraulic cylinder, a plurality of contact members within the housing unit, a main contact attached to the measurement shaft for selectively engaging one or more of the contact members, and a plurality of display lights electrically connected to the contact members. The display lights illuminate when the main contact engages the corresponding contact members.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hydraulic stroke measuring system that will overcome the shortcomings of the prior art devices.

A second object is to provide a hydraulic stroke measuring system for accurately determining the cylinder rod position within a hydraulic cylinder.

Another object is to provide a hydraulic stroke measuring system that can be utilized with various types of actuators including but not limited to hydraulic cylinders.

An additional object is to provide a hydraulic stroke measuring system that efficiently informs the user of the exact position of the cylinder shaft.

A further object is to provide a hydraulic stroke measuring system that reassures a user that a piece of equipment is being operated properly.

Another object is to provide a hydraulic stroke measuring system that is comprised of a simple construction.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
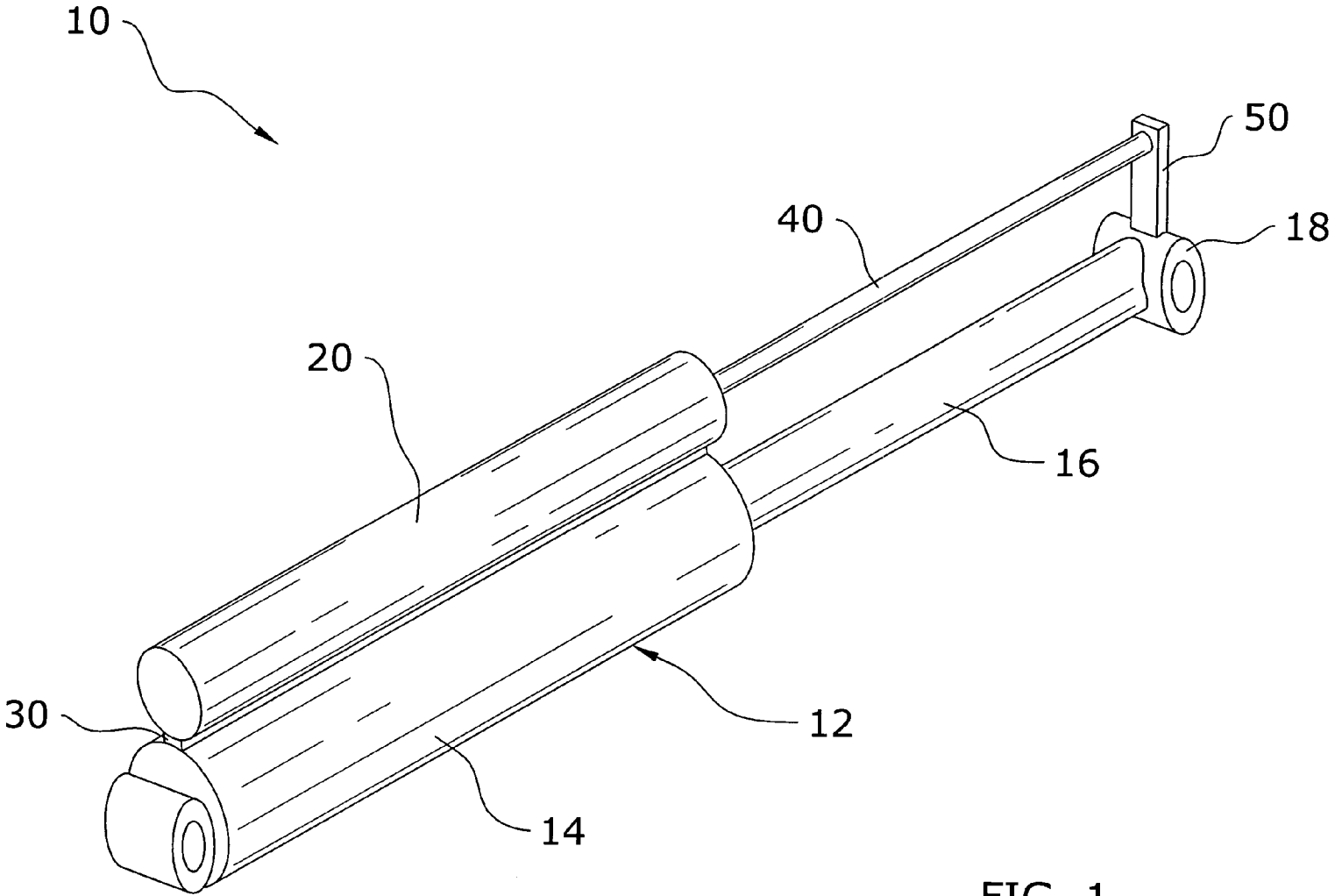
FIG. 1 is an upper perspective view of the present invention attached to a hydraulic cylinder.

Turning now descriptively to the drawings, in which similar reference characters denote similar elements throughout the several views, FIGS. 1 through 7 illustrate a hydraulic stroke measuring system 10, which comprises a measurement shaft slidably positioned within a housing unit 20, a shaft bracket 50 attachable between the measurement shaft and a cylinder shaft 16 of a hydraulic cylinder 12, a plurality of contact members 46 within the housing unit 20, a main contact 44 attached to the measurement shaft for selectively engaging one or more of the contact members 46, and a plurality of display lights 62 electrically connected to the contact members 46. The display lights 62 illuminate when the main contact 44 engages the corresponding contact members 46.

B. Measurement Unit

The measurement unit is preferably attached to a cylinder shaft 16 of a hydraulic cylinder 12 by a housing bracket 30. However, the measurement unit may be attached to various other structures near the hydraulic cylinder 12. The measurement unit measures an extended position of the cylinder shaft 16 with respect to the cylinder housing 14.

The measurement unit is comprised of a housing unit 20, a plurality of contact members 46, a measurement shaft, and a main contact 44. The housing unit 20 preferably has a tubular structure as shown in FIGS. 1 through 4 of the drawings. The housing unit 20 may have various other structures other than illustrated in the drawings as can be appreciated.

Figure 2:
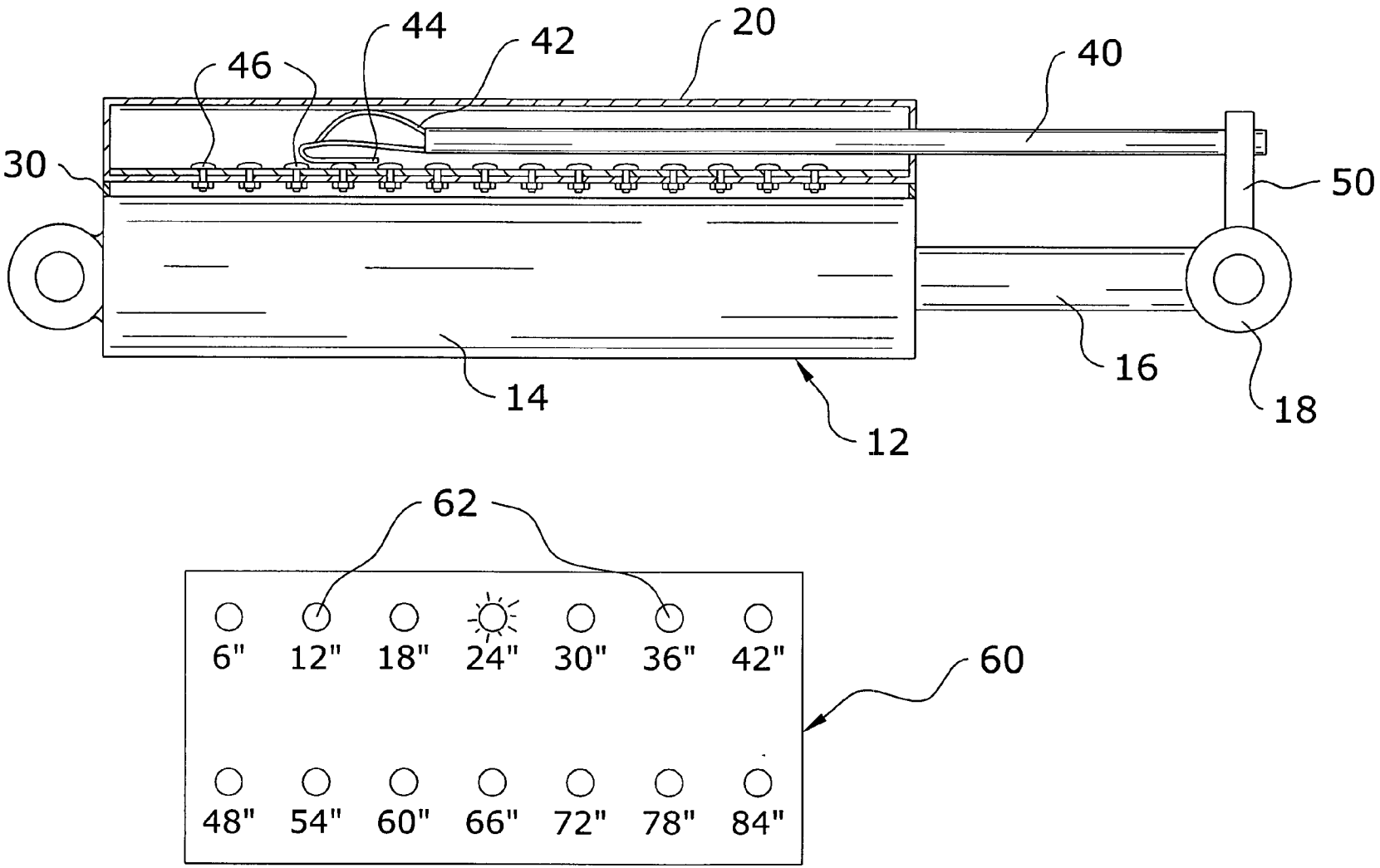
FIG. 2 is a side cutaway view of the present invention along with a display unit illustrating the cylinder shaft in a first position.
Figure 3:
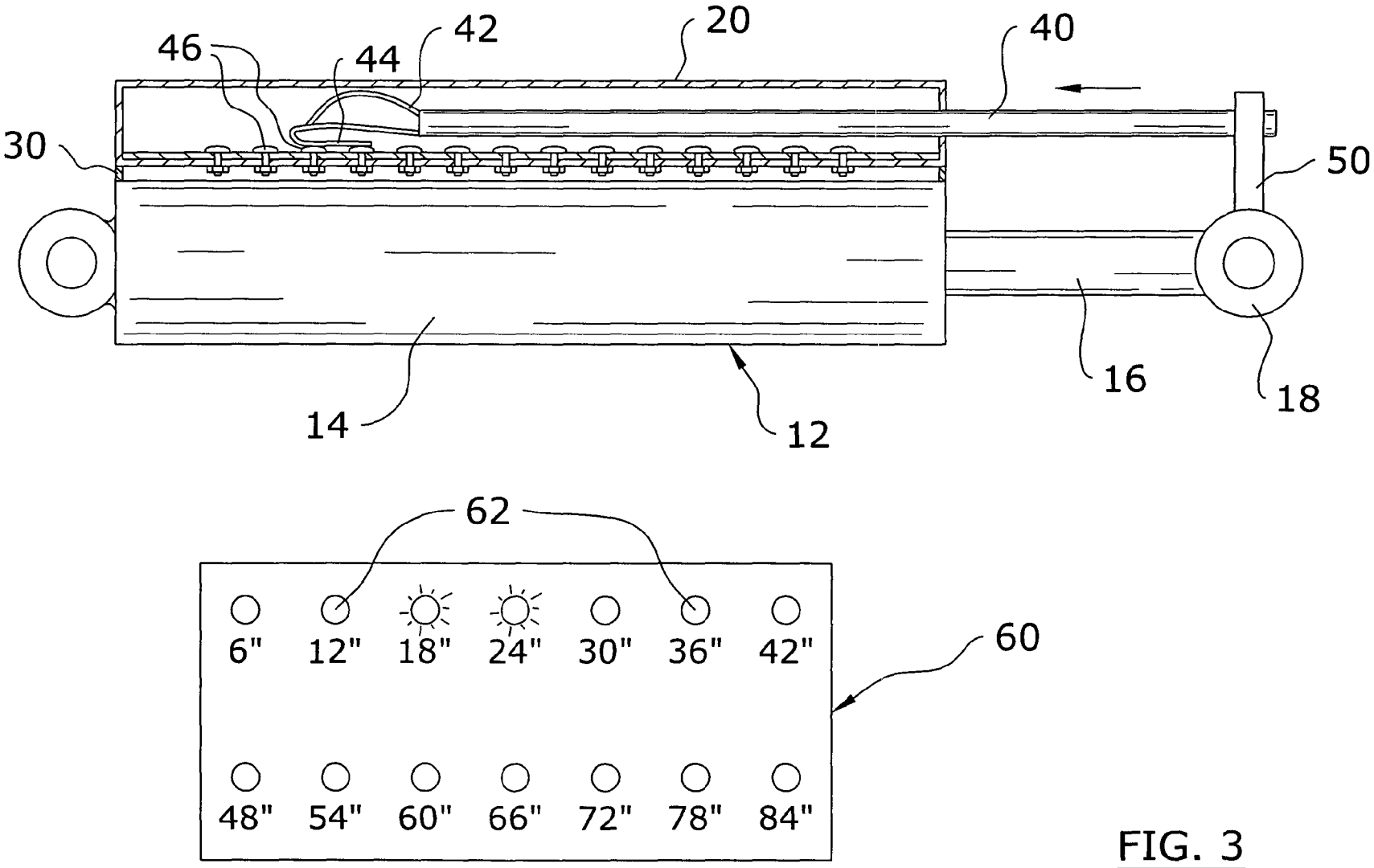
FIG. 3 is a side cutaway view of the present invention along with a display unit illustrating the cylinder shaft in a second position.
Figure 4:
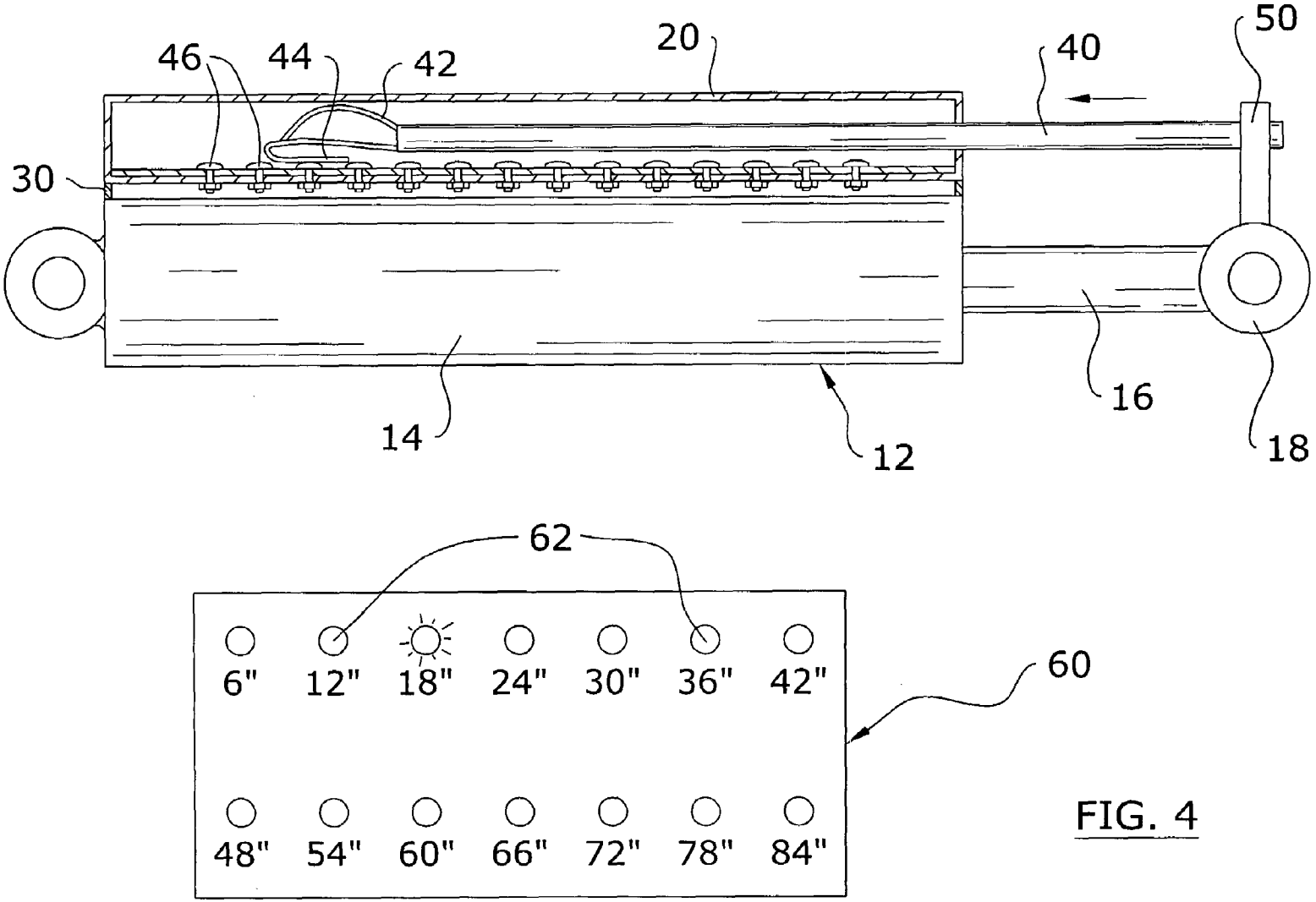
FIG. 4 is a side cutaway view of the present invention along with a display unit illustrating the cylinder shaft in a third position.

The plurality of contact members 46 are attached within the housing unit 20 as shown in FIGS. 2 through 6 of the drawings. The contact members 46 are electrically connected to the display lights 62 as best illustrated in FIG. 7 of the drawings. The display lights 62 are electrically connected to a power source 11 (e.g. battery, electrical system of a vehicle) as further shown in FIG. 7 of the drawings. The contact members 46 are constructed of a metal structure capable of electrically communicating with the main contact 44 to illuminate the corresponding display lights 62. The contact members 46 are preferably aligned in a row and equidistantly spaced, wherein the row of contact members 46 is aligned with the longitudinal axis of the cylinder shaft 16 as shown in FIGS. 2 through 4 of the drawings.

As shown in FIGS. 2 through 4 of the drawings, a measurement shaft slidably extends from within the housing unit 20. The measurement shaft is attachable to the cylinder shaft 16 of the hydraulic cylinder 12 by a shaft bracket 50 or other structure as shown in FIGS. 1 through 4 of the drawings. The shaft bracket 50 preferably is attached to the end connector 18 of the cylinder shaft 16, however the shaft bracket 50 may be attached in various other locations along the cylinder shaft 16.

The main contact 44 is attached to an inner end of the measurement shaft as shown in FIGS. 2 through 6 of the drawings. The main contact 44 is comprised of an electrical conducting material that engages one or more of the contact members 46 based upon a position of the measurement shaft. The main contact 44 is electrically connected to the power source 11 as also shown in FIG. 7 of the drawings. When the main contact 44 electrically contacts one or more of the contact members 46, an electrical circuit is closed through one or more of the corresponding display lights 62 thereby illuminating the corresponding display lights 62.

Figure 5:
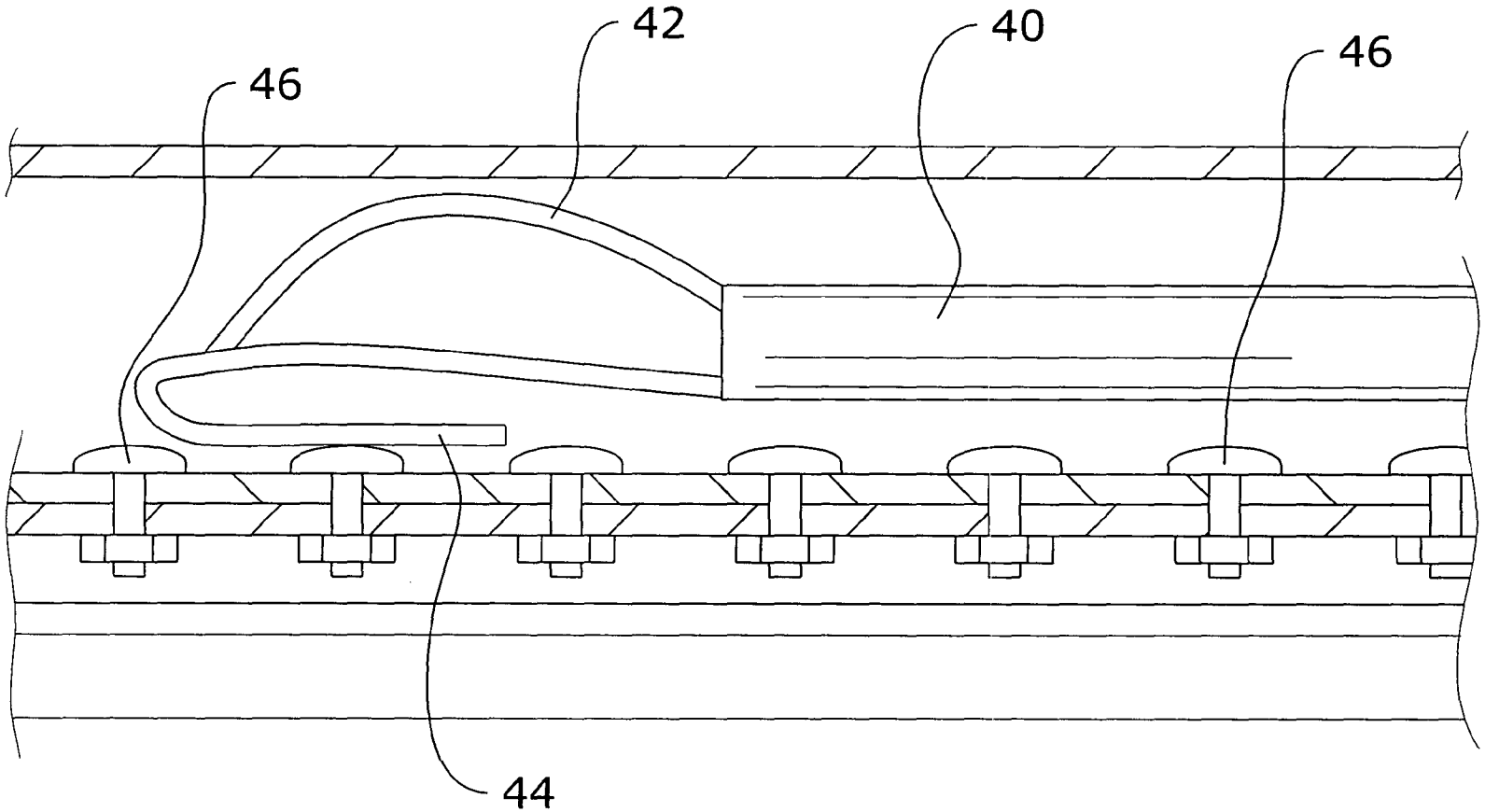
FIG. 5 is a magnified side cutaway view of the housing unit showing the main contact in electrical contact with only one contact member.
Figure 6:
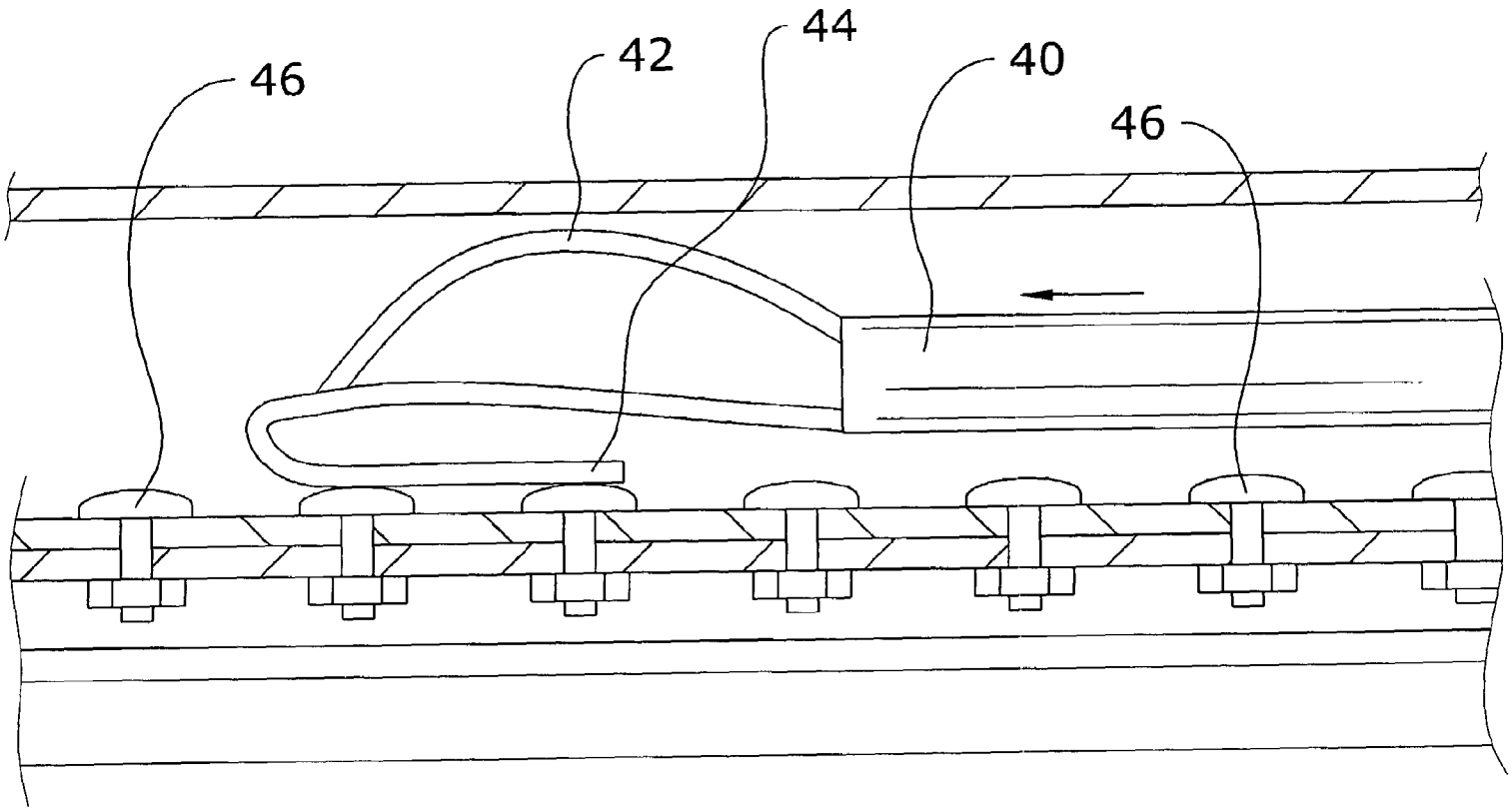
FIG. 6 is a magnified side cutaway view of the housing unit showing the main contact in electrical contact with two contact members.
Figure 7:
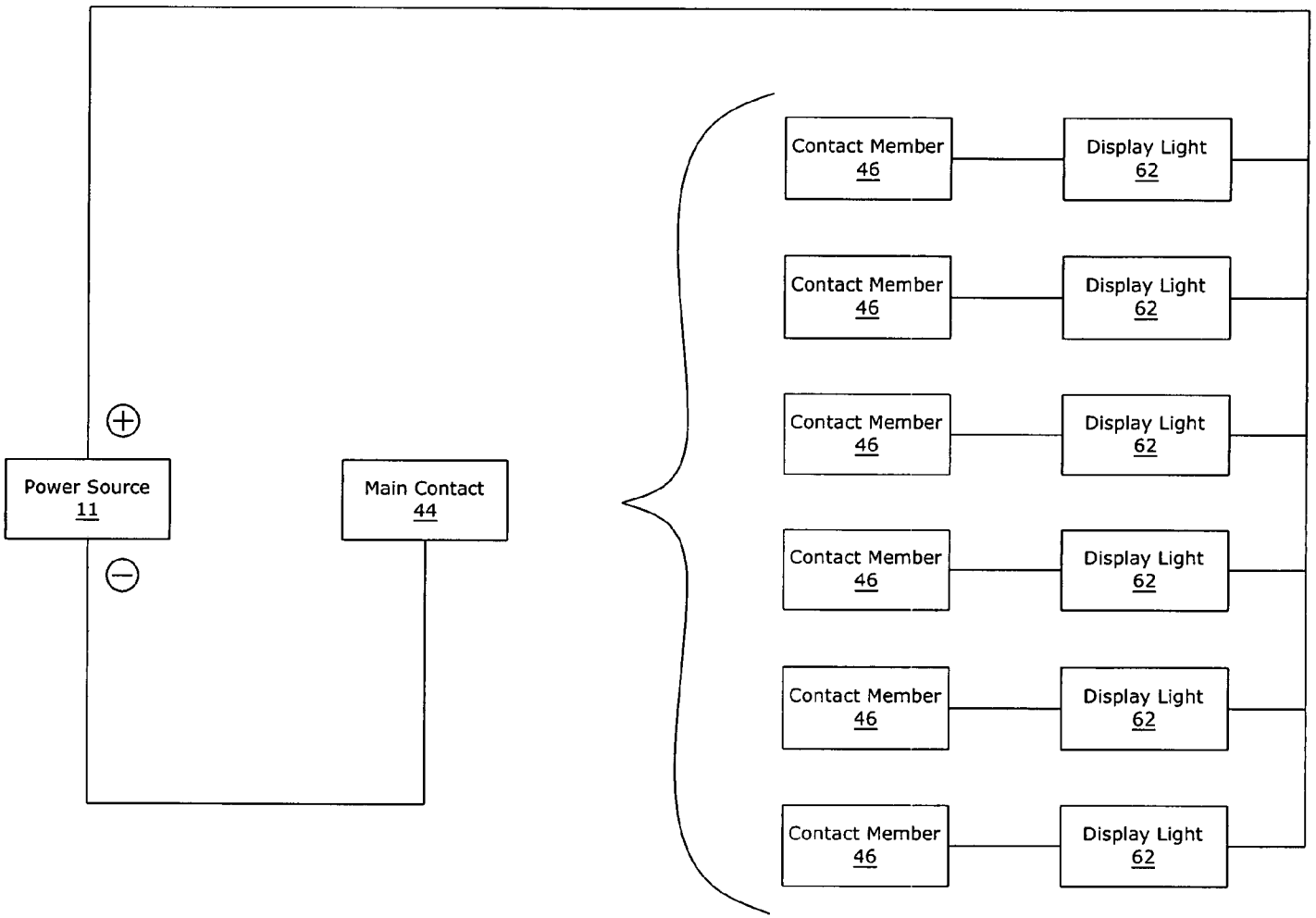
FIG. 7 is a block diagram illustrating the overall electrical connections of the present invention.

The main contact 44 is sufficient in length to engage at least two of the contact members 46 simultaneously as shown in FIGS. 3 and 6 of the drawings. This allows for the illumination of more than one of the display lights 62 to indicate positions of the cylinder shaft 16 between two display lights 62. A bias member 42 is preferably attached to the measurement shaft that applies a bias force to the main contact 44 towards the contact members 46 as best illustrated in FIGS. 5 and 6 of the drawings.

C. Display Unit

A display unit 60 is in communication with the plurality of contact members 46. The display unit 60 includes a plurality of display lights 62. Each of the display lights 62 is electrically connected to one of the contact members 46 as shown in FIG. 7 of the drawings. The display lights 62 indicate an extended position of the cylinder shaft 16.

An indicia is preferably positioned adjacent to each of the display lights 62 indicating a position measurement. For example, the indicia may display the depth a seeder is with ground surface.

D. Operation

The hydraulic stroke measurement system 10 is attached to a hydraulic cylinder 12 or other actuator unit. As the cylinder shaft 16 of the hydraulic cylinder 12 is extended from the cylinder housing 14, the measuring shaft 40 moves correspondingly as shown in FIGS. 2 through 4 of the drawings.

As the measuring shaft 40 is moved within the housing unit 20, the main contact 44 makes electrical contact with one or more of the contact members 46 as shown in FIGS. 2 through 6 of the drawings. FIG. 2 illustrates the main contact 44 electrically contacting a single contact member 46 which illuminates a single display light 62 within the display unit 60 corresponding to 24 inches. FIG. 3 illustrates the cylinder shaft 16 being retracted a finite distance with the main contact 44 electrically contacting two contact members 46 which illuminates two corresponding display lights 62 within the display unit 60 corresponding to 18 inches and 24 inches (thereby representing a measurement between these two).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hydraulic stroke measuring system, comprising:

a measurement unit attachable to a cylinder shaft of a hydraulic cylinder, wherein said measurement unit measures an extended position of a cylinder shaft; and a display unit with a plurality of display lights in communication with said measurement unit, wherein said display lights indicate an extended position of a cylinder shaft;

wherein said measurement unit is comprised of:

a housing unit having a tubular structure;

a plurality of contact members attached within said housing unit, wherein said contact members are electrically connected to said display lights;

a measurement shaft slidably extending from within said housing unit and attachable to a cylinder shaft of a hydraulic cylinder; and a main contact attached to said measurement shaft that engages one or more of said contact members based upon a position of said measurement shaft.

2. The hydraulic stroke measuring system of claim 1, including an indicia adjacent each of said display lights indicating a position measurement.

3. The hydraulic stroke measuring system of claim 1, wherein said main contact and said display lights are electrically connected to a power source.

4. The hydraulic stroke measuring system of claim 1, wherein said contact members are aligned in a row.

5. The hydraulic stroke measuring system of claim 4, wherein said contact members are separated equidistantly.

6. The hydraulic stroke measuring system of claim 1, wherein said main contact is sufficient in length to engage at least two of said contact members simultaneously.

7. The hydraulic stroke measuring system of claim 1, including a bias member attached to said measurement shaft and applying a bias force to said main contact towards said contact members.

8. The hydraulic stroke measuring system of claim 1, wherein said measurement shaft is attachable to said cylinder shaft by a shaft bracket.

9. The hydraulic stroke measuring system of claim 1, wherein said main contact is attached to an inner end of said measurement shaft.

10. A hydraulic stroke measuring system, comprising:

a measurement unit attached to a cylinder shaft of a hydraulic cylinder by a housing bracket, wherein said measurement unit measures an extended position of said cylinder shaft; and a display unit with a plurality of display lights in communication with said measurement unit, wherein said display lights indicate an extended position of said cylinder shaft;

wherein said measurement unit is comprised of:

a housing unit having a tubular structure;

a plurality of contact members attached within said housing unit, wherein said contact members are electrically connected to said display lights;

a measurement shaft slidably extending from within said housing unit and attachable to a cylinder shaft of a hydraulic cylinder; and a main contact attached to said measurement shaft that engages one or more of said contact members based upon a position of said measurement shaft.

11. The hydraulic stroke measuring system of claim 10, including an indicia adjacent each of said display lights indicating a position measurement.

12. The hydraulic stroke measuring system of claim 10, wherein said main contact and said display lights are electrically connected to a power source.

13. The hydraulic stroke measuring system of claim 10, wherein said contact members are aligned in a row.

14. The hydraulic stroke measuring system of claim 13, wherein said contact members are separated equidistantly.

15. The hydraulic stroke measuring system of claim 10, wherein said main contact is sufficient in length to engage at least two of said contact members simultaneously.

16. The hydraulic stroke measuring system of claim 10, including a bias member attached to said measurement shaft and applying a bias force to said main contact towards said contact members.

17. The hydraulic stroke measuring system of claim 10, wherein said measurement shaft is attachable to said cylinder shaft by a shaft bracket.

18. A hydraulic stroke measuring system, comprising:

a measurement unit attached to a cylinder shaft of a hydraulic cylinder by a housing bracket, wherein said measurement unit measures an extended position of said cylinder shaft;

a display unit with a plurality of display lights in communication with said measurement unit, wherein said display lights indicate an extended position of said cylinder shaft;

an indicia adjacent each of said display lights indicating a position measurement;

wherein said measurement unit is comprised of:

a housing unit having a tubular structure;

a plurality of contact members attached within said housing unit, wherein said contact members are electrically connected to said display lights;

a measurement shaft slidably extending from within said housing unit and attachable to said cylinder shaft of said hydraulic cylinder;

a main contact attached to an inner end of said measurement shaft that engages one or more of said contact members based upon a position of said measurement shaft;

wherein said main contact and said display lights are electrically connected to a power source;

wherein said contact members are aligned in a row and equidistantly spaced;

wherein said main contact is sufficient in length to engage at least two of said contact members simultaneously;

a bias member attached to said measurement shaft and applying a bias force to said main contact towards said contact members;

wherein said measurement shaft is attachable to said cylinder shaft by a shaft bracket.

* * * * *